US006505927B2

(12) United States Patent
Anagnostopoulos et al.

(10) Patent No.: US 6,505,927 B2
(45) **Date of Patent: *Jan. 14, 2003**

(54) APPARATUS AND METHOD FOR DRYING RECEIVER MEDIA IN AN INK JET PRINTER

(75) Inventors: Constantine N. Anagnostopoulos, Mendon, NY (US); David S. Ross, Fairport, NY (US); James M. Chwalek, Pittsford, NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/464,227

(22) Filed: Dec. 15, 1999

(65) Prior Publication Data

US 2002/0006299 A1 Jan. 17, 2002

(51) Int. Cl.[7] ..... B41J 2/01; B41J 2/17; B41J 13/02; B65H 7/02

(52) U.S. Cl. ..... 347/101; 347/103; 347/84; 400/635; 271/276

(58) Field of Search ..... 347/35, 102, 103, 347/84, 101; 355/312; 346/75, 25; 271/276; 400/635

(56) References Cited

U.S. PATENT DOCUMENTS

| | | | | |
|---|---|---|---|---|
| 4,283,730 A | * | 8/1981 | Graf | 346/75 |
| 4,340,893 A | | 7/1982 | Ort | |
| 4,751,528 A | | 6/1988 | Spehrley, Jr. et al. | |
| 4,928,112 A | | 5/1990 | Hock et al. | |
| 5,005,025 A | | 4/1991 | Miyakawa et al. | |
| 5,020,244 A | | 6/1991 | Smith | |
| 5,296,873 A | | 3/1994 | Russell et al. | |
| 5,467,180 A | * | 11/1995 | Malachowski et al. | 355/312 |
| 5,510,822 A | | 4/1996 | Vincent et al. | |
| 5,526,028 A | | 6/1996 | Rottman | |
| 5,625,398 A | | 4/1997 | Milkovits et al. | |
| 5,717,446 A | * | 2/1998 | Teumer et al. | 347/35 |
| 5,856,023 A | * | 1/1999 | Chen et al. | 428/520 |
| 5,896,154 A | | 4/1999 | Mitani et al. | |
| 5,897,961 A | * | 4/1999 | Malhotra et al. | 428/537.5 |
| 6,003,989 A | * | 12/1999 | Chen et al. | 347/105 |
| 6,110,601 A | * | 9/2000 | Shaw-Klein et al. | 428/522 |

FOREIGN PATENT DOCUMENTS

| | | |
|---|---|---|
| EP | 0 624 477 A2 | 11/1994 |
| EP | 0 875 382 A2 | 11/1998 |

* cited by examiner

*Primary Examiner*—Ren Yan
*Assistant Examiner*—Marvin P. Crenshaw
(74) *Attorney, Agent, or Firm*—Walter S. Stevens; Norman Rushefsky

(57) ABSTRACT

An apparatus and method for drying a receiver media (30) in an ink jet printer. The apparatus generally comprises a means for creating a pressure differential between the upper surface (20) and the lower surface (50) of the receiver media (30), wherein the pressure at the lower surface (50) of the receiver media (30) is lower than the pressure at the upper surface (20) of the receiver media (30). The pressure differential-creating means may include a vacuum pump (70) adapted to generate a vacuum at the lower surface (50) of the receiver media (30) or an air pump (130) adapted to pass air currents (140) across the lower surface (50) of the receiver media (30) to cause a "Bernoulli effect". The method generally comprises the steps of depositing ink droplets (10) onto the upper surface (20) of the receiver media (30); and creating a pressure differential between the upper surface (20) and the lower surface (50) of the receiver media (30), whereby carrier fluid contained in ink droplets (10) is drawn through the receiver media (30) from the upper surface (20) to the lower surface (50).

14 Claims, 4 Drawing Sheets

APPARATUS AND METHOD FOR DRYING RECEIVER MEDIA IN AN INK JET PRINTER

FIELD OF THE INVENTION

This invention pertains generally to the field of liquid ink jet printer systems, and more particularly to an apparatus and method for drying receiver media in an ink jet printing system.

BACKGROUND OF THE INVENTION

For photographic-quality ink jet printing, it is desirable to deposit a number of droplets at each location in the paper, so that a sufficiently high gray-scale is obtained. In prior art scanning-type print heads, this is accomplished by reciprocating the print head over the same location on the receiver a number of times and depositing ink droplets as required by the images to be printed. Since it takes several hundred milliseconds (msec) for the printhead to return to a previous location, any ink droplets deposited at that location will have adequate time to diffuse many microns into the paper receiver. Ink droplets that are subsequently deposited at that location can then be deposited on top of the previous droplets without producing visible artifacts.

In a high-speed, high-resolution ink jet printing system, such as page-width ink jet printing systems, the relatively long time of 1 to 100 msec or more required for the ink to diffuse into the paper receiver (away from the receiver surface) produces visible artifacts. For example, if an x-y (Cartesian coordinates) array of droplets are deposited on the receiver at a predetermined printhead resolution, the separate droplets coalesce into a larger droplet that results in an uneven distribution of dye and thus a possible undesirable image artifact. This is illustrated in FIGS. 1A and 1B, where FIG. 1A shows a plurality of ink droplets 10 deposited on a surface 20 of a paper receiver 30, and FIG. 1B shows droplets 10 having coalesced into a "coalesced" droplet 40. FIG. 1C shows a desired dye diffusion pattern into the paper receiver, and FIG. 1D shows an undesirable non-uniform dye distribution due to droplet coalescence.

The situation is worse in multicolor closely-spaced page-width printhead systems, wherein an undesirable mixing of different color dyes can take place due to coalescence.

Droplet coalescence occurs because of the slow rate of penetration of ink into the paper receiver. This rate is at best approximately 30 $\mu$m in 100 msec. To avoid coalescence, this penetration rate should be increased to approximately 30 $\mu$m in 30 $\mu$sec, which is approximately 1.0 $\mu$m/$\mu$sec.

SUMMARY OF THE INVENTION

The present invention pertains to an apparatus and method for drying a receiver media in an ink jet printer. By way of example and not of limitation, the apparatus of the present invention generally comprises a means for creating a pressure differential between the upper surface and the lower surface of the receiver media, wherein the pressure at the lower surface of the receiver media is lower than the pressure at the upper surface of the media. The pressure differential-creating means may include a vacuum pump adapted to generate a vacuum at the lower surface of the receiver media or an air pump adapted to pass air currents across the lower surface of the receiver media to cause a Bernoulli effect. Ink carrier fluid is recaptured and may be recycled.

By way of example and not of limitation, the method generally comprises the steps of depositing ink droplets onto the upper surface of the receiver media; and creating a pressure differential between the upper surface and the lower surface of the receiver media, whereby fluid contained in ink droplets is drawn through the receiver media from the upper surface to the lower surface.

The pressure differential between the lower surface and the upper surface of the receiver media eliminates ink droplet coalescence by increasing the flow rate of the ink fluid through the receiver media. The elimination and/or reduction of ink drop coalescence provides for a more uniform dye distribution on the receiver media, and hence, enhanced image quality from the ink jet printer.

BRIEF DESCRIPTION OF THE DRAWINGS

In the detailed description of the embodiments of the invention presented below, reference is made to the accompanying drawings, which are for illustrative purposes only.

DETAILED DESCRIPTION OF THE INVENTION

Referring more specifically to the drawings, for illustrative purposes the present invention is embodied in the apparatus generally shown in FIG. 2 through FIG. 6. It will be appreciated that the apparatus may vary as to configuration and as to details of the parts without departing from the basic concepts as disclosed herein.

Figure 1A:
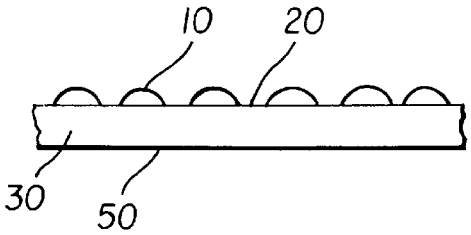
FIG. 1A is a side elevational view of ink droplets deposited on a surface of a receiver media.
Figure 1B:
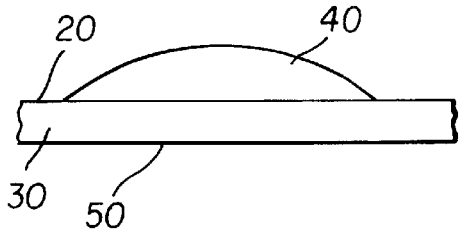
FIG. 1B is a side elevational view of the ink droplets shown in FIG. 1A, in which the ink droplets are coalesced into a single large drop.
Figure 1C:
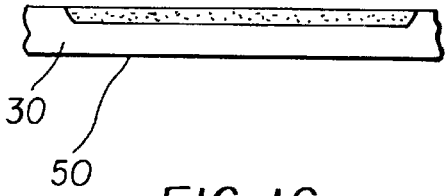
FIG. 1C is a cross-sectional view of a receiver media, showing a desired dye diffusion pattern on receiver media.
Figure 1D:
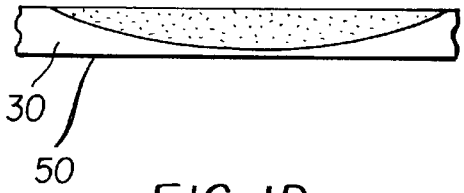
FIG. 1D is a cross-sectional view of the receiver media shown in FIG. 1C, showing an undesirable dye distribution pattern caused by ink droplet coalescence.
Figure 2:
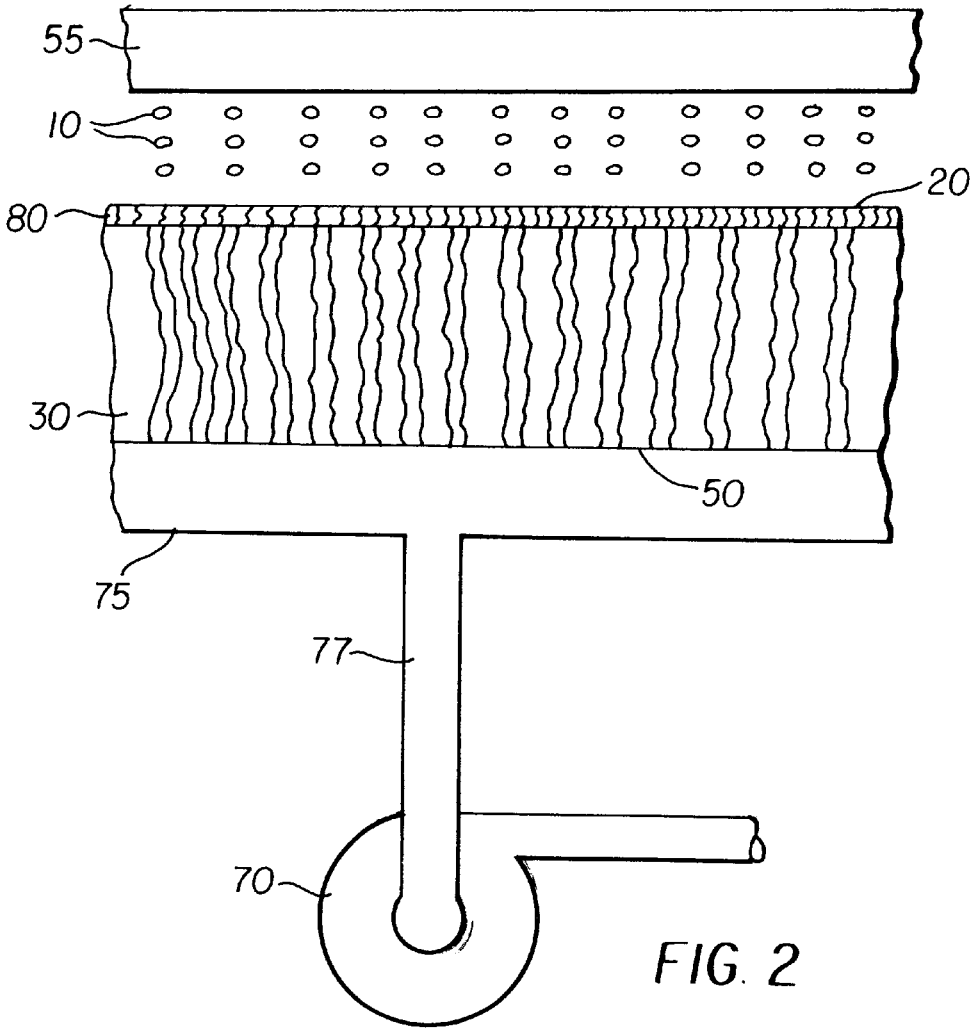
FIG. 2 is a functional view of a receiver media drying apparatus, in accordance with a first embodiment of the present invention, with a receiver media disposed thereon configured to print on the upper surface of the receiver media, shown along with a print head of an ink jet printer.
Figure 3:
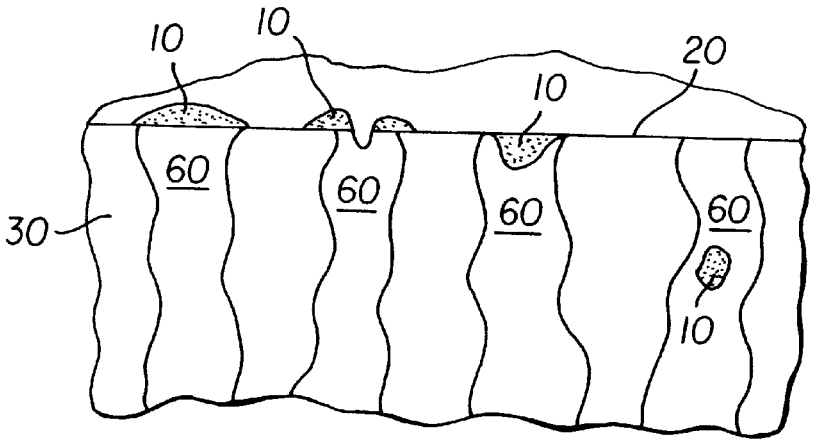
FIG. 3 is a cross-sectional view of the receiver media, shown in FIG. 2.

Referring to FIG. 2 and FIG. 3, a first embodiment of an apparatus for drying a receiver media 30 in an ink jet printer, in accordance with the present invention, is generally shown. The apparatus comprises a vacuum manifold 75, a pipe 77, and a vacuum pump 70.

Receiver media 30 includes an upper surface 20 and a lower surface 50. Vacuum manifold 75 is adapted to support a receiver media 30 thereon, which is typically a sheet of paper. When receiver media 30 is disposed on vacuum manifold 75, lower surface 50 of receiver media 30 abuts vacuum manifold 75, whereupon vacuum manifold 75 is in fluid communication with lower surface 50 of receiver media 30. Vacuum pump 70 is in fluid connection with vacuum manifold 75 through pipe 77. Vacuum pump 70 must be capable of generating a vacuum within vacuum manifold 75 at a level of at least approximately 5 psi measured at lower surface 50 of media receiver 30. Therefore, when vacuum pump 70 is generating a vacuum to the required level, a pressure differential of approximately 5 psi is created between upper surface 20 and lower surface 50 of receiver media 30.

Receiver media 30 is preferably photographic-quality inkjet paper that has pores 60 that traverse its entire thickness between upper surface 20 and lower surface 50. Pores 60 are approximately 5 $\mu$m in diameter, which is typical for photographic quality inkjet paper. Only some of pores 60 are shown and the size of pores 60 has been exaggerated for clarity in FIG. 3. Receiver media 30 also includes a mordant layer 80 disposed on upper surface 20, which is the printing side of receiver media 30. The presence of mordant layer 80 provides for the separation of the dye from the carrier fluid in ink droplets 10 that land on upper surface 20. The dye that remains on receiver media 30 become part of the image created on the printing side of receiver media 30. The remaining carrier fluid is vacuumed away after passage by capillary action through pores 60 in receiver media 30 by a vacuum applied by vacuum pump 70.

The ink jet printer referred to incorporates either a DOD (Drop On Demand) or CIJ (continuous inkjet) printhead 55. According to the first embodiment of the invention, when ink droplets 10 are deposited onto upper surface 20 of receiver media 30 by printhead 55, an increased penetration rate to approximately 1 $\mu$m/$\mu$sec and avoidance of droplet coalescence is accomplished by application of a vacuum at lower surface 50 of receiver 30.

Figure 4:
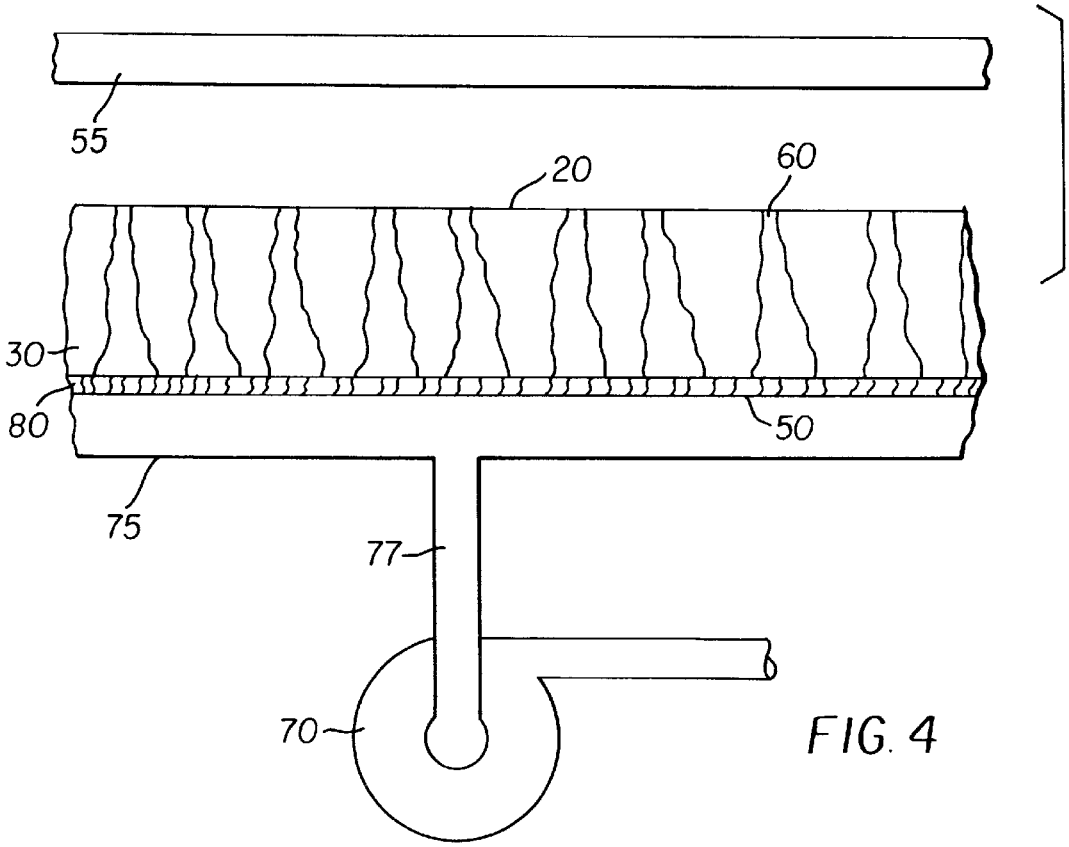
FIG. 4 is a functional view of a receiver media drying apparatus, in accordance with the present invention, with a receiver media disposed thereon configured to print on the lower surface of the receiver media, shown along with a print head of an ink jet printer.
Figure 5:
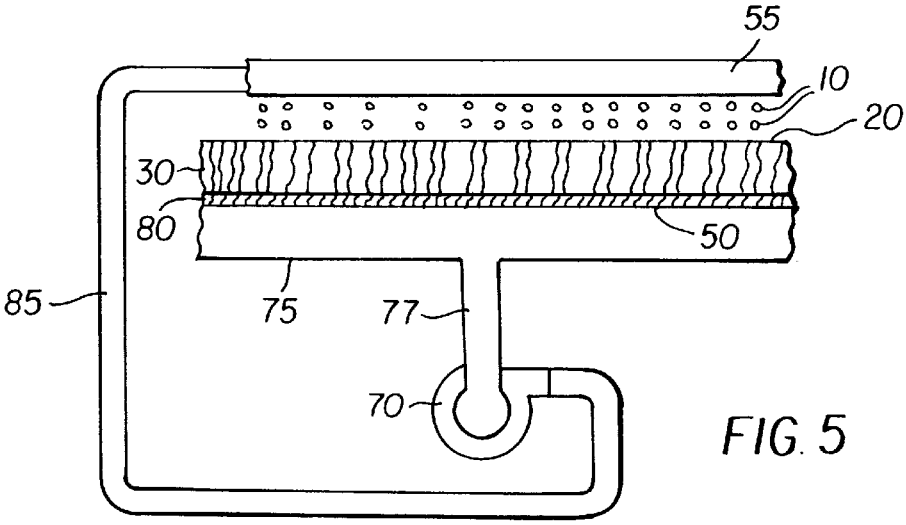
FIG. 5 is a functional view of a receiver media drying apparatus shown in FIG. 4, along with a fluid recycling means.

Alternatively, it may be seen in FIG. 4 and FIG. 5 that lower surface 50 of media receiver 30 may also serve as the printing side of receiver media 30. To print on lower surface 50, mordant layer 80 is disposed on lower surface 50 of receiver 30, rather than on upper surface 20 thereof. In this case, pores 60 may be larger than about 5 $\mu$m. Pores 60 are preferably not in liquid communication with each other in order to prevent diffusion of ink droplets 10. Ink droplets 10 from printhead 55 are still deposited on upper surface 20, however, the vacuum and capillary action transmits the ink from upper surface 20 through to lower surface 50, where the dye is captured but the carrier fluid is vacuumed away. Of course, the image now forms on back surface 50. The relatively high porosity of receiver 30 coupled with the vacuum reduces coalescence even further. Lower surface 50 of receiver media 30 preferably still remains porous enough to vacuum the carrier fluid out of receiver 30; but, its "effective" pore size is typically about 0.1 $\mu$m or less in diameter, so as to define a region 80 of small pore size. This region of small pores may be a glossy film which enhances the quality of the image, as is typically done for conventional photographs.

The carrier fluid may be recycled, to reduce costs and prevent saturating the environment with the carrier fluid vapors. To accomplish recycling of the ink carrier fluid, pump 70 is connected to a recirculation loop 85, which recirculates the solvent carrier fluid to printhead 55. It may be appreciated that recirculation loop 85 may be used with all embodiments of the invention.

Figure 6:
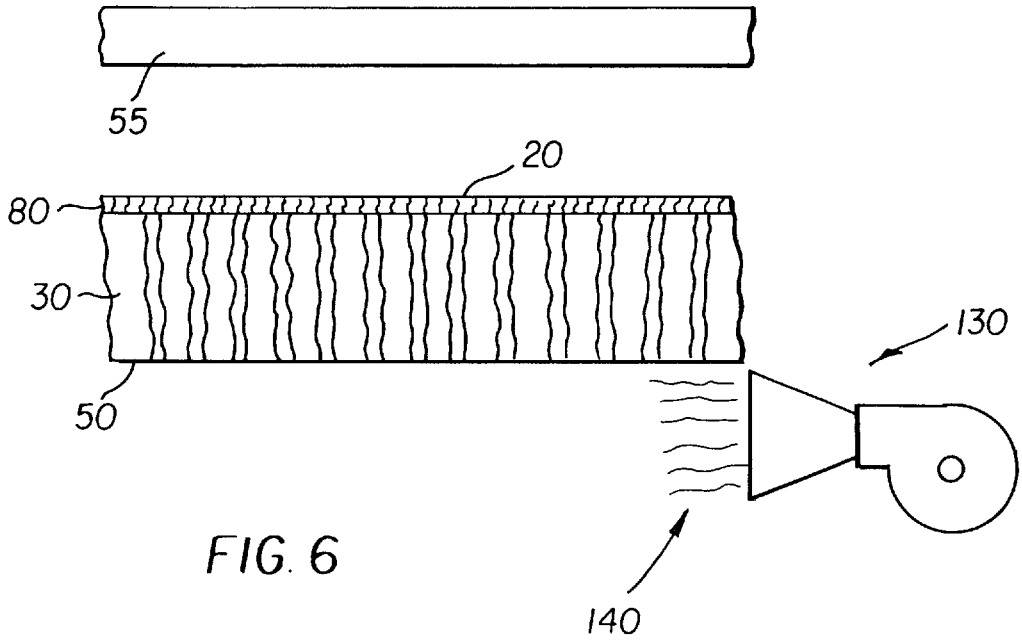
FIG. 6 is a functional view of a receiver media drying apparatus, in accordance with a second embodiment of the present invention, with a receiver media disposed thereon configured to print on the upper surface of the receiver media, shown along with a print head of an ink jet printer.

Referring also to FIG. 6, a second embodiment of an apparatus for drying receiver media 30 in an ink jet printer, in accordance with the present invention, is generally shown. The apparatus comprises an air blower means 130 adapted to generate and pass air across lower surface 50 of receiver media 30. Air blower means 130 preferably comprises a fan, or the like, capable of generating hot or cold air currents 140. Air currents 140 traverse in a direction generally parallel to lower surface 50 of receiver media 30. As air currents 140 traverse lower surface 50 of media receiver 30, carrier fluid will be drawn out of pores 60 due to the well-known Bernoulli effect, which creates a change in pressure across receiver media 30.

A method for drying receiver media 30 having upper surface 20 and lower surface 50, in an ink jet printer with printhead 55, generally comprises the following steps: (1) depositing ink droplets 10 onto upper surface 20 of receiver media 30; and (2) creating a pressure differential between upper surface 20 and the lower surface 50 of receiver media 30.

Mordant layer 80 may exist on either upper surface 20 or lower surface 50 of receiver media 30, depending on which surface is to be the printing side of receiver media 30. For the printing side to be on upper surface 20 of receiver media 30, mordant layer 80 must exist on upper surface 20. In this instance, the dye of ink droplets 10 is captured on upper surface 20 while the carrier fluid of ink droplets 10 is drawn through receiver media 30 from upper surface 20 to lower surface 50 due to the pressure differential. Alternatively, for the printing side to be on lower surface 50 of receiver media 30, mordant layer 80 must exist on lower surface 50. In this instance, the dye of ink droplets 10 is captured on lower surface 50, while the carrier fluid of ink droplets 10 are drawn through receiver media 30 from upper surface 20 to lower surface 50 due to the pressure differential.

The step of creating a pressure differential between upper surface 20 and the lower surface 50 of receiver media 30 may be accomplished either by application of a vacuum to lower surface 50 of receiver media 30 or by generating and passing air currents 140 across lower surface 50 of receiver media 30, in a direction generally perpendicular to the direction which the ink droplets 10 traverse through receiver media 30.

Since ink droplets 10 traverse through pores 60, which are disposed perpendicularly in receiver media 30 between upper surface 20 and lower surface 50, air currents 140 are directed generally parallel to lower surface 50 of receiver media 30.

Although the description above contains many specificities, these should not be construed as limiting the scope of the invention but as merely providing illustrations of some of the presently preferred embodiments of this invention. Thus the scope of this invention should be determined by the appended claims and their legal equivalents.

PARTS LIST

10 ink droplets
20 upper surface
30 receiver media
40 coalesced drop
50 lower surface
55 print head
70 vacuum pump
77 pipe
80 mordant layer
85 recirculation loop
130 blower means
140 air currents

What is claimed is:

1. An ink jet printer system for printing upon a receiver medium:

a receiver medium including a first surface and a second surface opposite the first surface, a porous structure of the receiver medium being between the first surface and the second surface, an image receiving layer being between the porous structure and the second surface;

an ink jet printer for applying ink in a carrier liquid as an image to the first surface;

a vacuum applying device operating to apply a vacuum to the second surface of the receiver medium at a location of the receiver medium directly opposite to a location where ink is applied by the ink jet printer to the first surface, the vacuum applying device being operative so as to cause the carrier liquid to be vacuumed away after passage through the porous structure of the receiver medium and to establish an image in the image receiving layer so that the image is established on the opposite side of the receiver medium from which the ink is deposited.

2. The ink jet printer system of claim 1 and wherein the vacuum applying device includes a vacuum manifold that is adapted to support the receiver medium.

3. The ink jet printer system of claim 2 and wherein the vacuum applying device establishes a pressure differential of at least five psi between the first surface and the second surface so as to cause the carrier liquid to be vacuumed away after passage through pores in the receiver medium.

4. The ink jet printer system of claim 1 and wherein the vacuum applying device establishes a pressure differential of at least five psi between the first surface and the second surface so as to cause the carrier liquid to be vacuumed away after passage through pores in the receiver medium.

5. The ink jet printer system of claim 1 and wherein the image receiving layer is a mordant layer.

6. In an ink jet printer apparatus for depositing ink in a carrier liquid onto a porous receiver medium, a method of printing with rapid diffusing of the ink into the porous receiver medium, the receiver medium including a first surface and a second surface opposite the first surface and a porous structure between the first surface and the second surface, an image receiving layer being formed between the porous structure and the second surface, the method comprising:

applying the ink from an ink jet printer as an image to the first surface;

applying, at a location on the second surface of the receiver medium directly opposite a location on the first surface upon which the image is deposited, a pressure differential between the first surface and the second surface so as to cause the carrier liquid to be vacuumed away after passage through the pores in the porous structure of the receiver medium, the image receiving layer receiving ink dye from the ink to form an image in the image receiving layer on the side of the receiver medium opposite to that which ink is deposited.

7. The method of claim 6 and wherein the pressure differential is at least five psi.

8. The method of claim 7 and wherein the receiver medium is photographic quality ink jet paper.

9. The method of claim 8 and wherein the image receiving layer has pores that are about 0.1 micrometers in diameter.

10. The method according to claim 9 and wherein pores in the porous structure are about 5 micrometers in diameter.

11. The method of claim 6 and wherein the receiver medium is photographic quality ink jet paper.

12. The method of claim 6 and wherein the image receiving layer has pores that are about 0.1 micrometers in diameter.

13. The method according to claim 12 and wherein pores in the porous structure are about 5 micrometers in diameter.

14. The method according to claim 6 and wherein the image receiving layer is a mordant layer.

* * * * *